US011250770B1

(12) United States Patent
Wu

(10) Patent No.: US 11,250,770 B1
(45) Date of Patent: Feb. 15, 2022

(54) DE-JAGGY PROCESSING SYSTEM AND METHOD FOR OLED DISPLAY WITH CURVED SPACE

(71) Applicant: Himax Technologies Limited, Tainan (TW)

(72) Inventor: Tung Ying Wu, Tainan (TW)

(73) Assignee: Himax Technologies Limited, Tainan (TW)

( * ) Notice: Subject to any disclaimer, the term of this patent is extended or adjusted under 35 U.S.C. 154(b) by 0 days.

(21) Appl. No.: 17/025,406

(22) Filed: Sep. 18, 2020

(51) Int. Cl.
*G09G 3/3208* (2016.01)
*G09G 3/04* (2006.01)

(52) U.S. Cl.
CPC ..... *G09G 3/3208* (2013.01); *G09G 3/04* (2013.01); *G09G 2310/0221* (2013.01); *G09G 2320/0233* (2013.01); *G09G 2320/0242* (2013.01); *G09G 2360/16* (2013.01)

(58) Field of Classification Search
CPC ..... G09G 3/3208; G09G 3/04; G09G 2310/0221; G09G 2320/0233; G09G 2320/0242; G09G 2360/16; G09G 3/3666; G09G 3/2003; G09G 3/32; G09G 3/3258; G09G 3/3275; G09G 5/10; G09G 3/3291; G09G 3/2092; G09G 5/005; H04N 19/61
See application file for complete search history.

(56) References Cited

U.S. PATENT DOCUMENTS

2003/0174151 A1* 9/2003 Awamoto ..... G09G 5/005 345/690
2004/0061705 A1* 4/2004 Yoon ..... G09G 5/10 345/589
2010/0245672 A1* 9/2010 Erdler ..... H04N 19/61 348/608
2016/0240140 A1* 8/2016 Park ..... G09G 3/3258
2018/0075797 A1* 3/2018 Park ..... G09G 3/2092
2018/0082625 A1* 3/2018 Yang ..... G09G 3/3275
2018/0090049 A1* 3/2018 Kim ..... G09G 3/3666
2018/0130437 A1* 5/2018 Park ..... G09G 3/2092
2018/0144690 A1* 5/2018 Inokawa ..... G09G 3/32
2019/0073962 A1* 3/2019 Aflatooni ..... G09G 3/3275
2019/0312098 A1* 10/2019 Matsueda ..... G09G 3/3291
2019/0312099 A1* 10/2019 Matsueda ..... G09G 3/2003

* cited by examiner

*Primary Examiner* — Richard J Hong
(74) *Attorney, Agent, or Firm* — Donald E. Stout; Stout, Uxa & Buyan, LLP

(57) ABSTRACT

A de-jaggy processing method includes dividing a display area of a display into a plurality of sub-areas; providing a first table composed of gray-level weights associated with corresponding luminances of each primary color for each said sub-area; providing a second table composed of distance-gain weights each correspondingly associated with a distance between a sub-pixel and a reference point; and obtaining a corrected luminance of a sub-pixel of a pixel by multiplying an original luminance of the sub-pixel by a corresponding gray-level weight and a corresponding distance-gain weight.

14 Claims, 6 Drawing Sheets

X coordinate

| Y coordinate | 0 | 8 | 16 | 32 | 48 | 64 | 80 | 96 | 112 | 128 | 144 | 160 | 176 | 192 | 208 | 244 | 240 |
|---|---|---|---|---|---|---|---|---|---|---|---|---|---|---|---|---|---|
| 0 | 1 | 1 | 0.9 | 1 | 1 | 1 | 1 | 1 | 1 | 1 | 1 | 1 | 1 | 1 | 0.9 | 1 | 1 |
| 8 | 1 | 0.9 | 0.9 | 1 | 1 | 1 | 1 | 1 | 1 | 1 | 1 | 1 | 1 | 1 | 0.9 | 0.9 | 1 |
| 16 | 1 | 0.9 | 1 | 1 | 1 | 1 | 1 | 1 | 1 | 1 | 1 | 1 | 1 | 1 | 1 | 0.9 | 1 |
| 32 | 1 | 1 | 1 | 1 | 1 | 1 | 1 | 1 | 1 | 1 | 1 | 1 | 1 | 1 | 1 | 1 | 1 |
| 48 | 1 | 1 | 1 | 1 | 1 | 1 | 1 | 1 | 1 | 1 | 1 | 1 | 1 | 1 | 1 | 1 | 1 |
| 64 | 1 | 1 | 1 | 1 | 1 | 1 | 1 | 1 | 1 | 1 | 1 | 1 | 1 | 1 | 1 | 1 | 1 |
| 80 | 1 | 1 | 1 | 1 | 1 | 1 | 1 | 1 | 1 | 1 | 1 | 1 | 1 | 1 | 1 | 1 | 1 |
| 96 | 1 | 1 | 1 | 1 | 1 | 1 | 1 | 1 | 1 | 1 | 1 | 1 | 1 | 1 | 1 | 1 | 1 |
| 112 | 1 | 1 | 1 | 1 | 1 | 1 | 1 | 1 | 1 | 1 | 1 | 1 | 1 | 1 | 1 | 1 | 1 |
| 128 | 1 | 1 | 1 | 1 | 1 | 1 | 1 | 1 | 1 | 1 | 1 | 1 | 1 | 1 | 1 | 1 | 1 |
| 144 | 1 | 1 | 1 | 1 | 1 | 1 | 1 | 1 | 1 | 1 | 1 | 1 | 1 | 1 | 1 | 1 | 1 |
| 160 | 1 | 1 | 1 | 1 | 1 | 1 | 1 | 1 | 1 | 1 | 1 | 1 | 1 | 1 | 1 | 1 | 1 |
| 176 | 1 | 1 | 1 | 1 | 1 | 1 | 1 | 1 | 1 | 1 | 1 | 1 | 1 | 1 | 1 | 1 | 1 |
| 192 | 1 | 1 | 1 | 1 | 1 | 1 | 1 | 1 | 1 | 1 | 1 | 1 | 1 | 1 | 1 | 1 | 1 |
| 208 | 1 | 0.9 | 1 | 1 | 1 | 1 | 1 | 1 | 1 | 1 | 1 | 1 | 1 | 1 | 1 | 0.9 | 1 |
| 224 | 1 | 0.9 | 0.9 | 1 | 1 | 1 | 1 | 1 | 1 | 1 | 1 | 1 | 1 | 1 | 0.9 | 0.9 | 1 |
| 240 | 1 | 1 | 0.9 | 1 | 1 | 1 | 1 | 1 | 1 | 1 | 1 | 1 | 1 | 1 | 0.9 | 1 | 1 |

| GL | R | G | B | GL | R | G | B |
|---|---|---|---|---|---|---|---|
| 0 | 0 | 0 | 0 | 0 | 0 | 0 | 0 |
| 16 | 0.9 | 1 | 1 | 16 | 1 | 1 | 0.86 |
| ... | ... | ... | ... | ... | ... | ... | ... |
| 255 | 0.85 | 1 | 1 | 255 | 1 | 1 | 0.83 |
| GL | R | G | B | GL | R | G | B |
| 0 | 0 | 0 | 0 | 0 | 0 | 0 | 0 |
| 16 | 1 | 0.92 | 1 | 16 | 1 | 1 | 0.86 |
| ... | ... | ... | ... | ... | ... | ... | ... |
| 255 | 1 | 0.85 | 1 | 255 | 1 | 1 | 0.83 |

*FIG. 4*

X coordinate

| Y coordinate | 0 | 8 | 16 | 32 | 48 | 64 | 80 | 96 | 112 | 128 | 144 | 160 | 176 | 192 | 208 | 244 | 240 |
|---|---|---|---|---|---|---|---|---|---|---|---|---|---|---|---|---|---|
| 0 | 1 | 1 | 0.9 | 1 | 1 | 1 | 1 | 1 | 1 | 1 | 1 | 1 | 1 | 1 | 0.9 | 1 | 1 |
| 8 | 1 | 0.9 | 0.9 | 1 | 1 | 1 | 1 | 1 | 1 | 1 | 1 | 1 | 1 | 1 | 0.9 | 0.9 | 1 |
| 16 | 1 | 0.9 | 1 | 1 | 1 | 1 | 1 | 1 | 1 | 1 | 1 | 1 | 1 | 1 | 1 | 0.9 | 1 |
| 32 | 1 | 1 | 1 | 1 | 1 | 1 | 1 | 1 | 1 | 1 | 1 | 1 | 1 | 1 | 1 | 1 | 1 |
| 48 | 1 | 1 | 1 | 1 | 1 | 1 | 1 | 1 | 1 | 1 | 1 | 1 | 1 | 1 | 1 | 1 | 1 |
| 64 | 1 | 1 | 1 | 1 | 1 | 1 | 1 | 1 | 1 | 1 | 1 | 1 | 1 | 1 | 1 | 1 | 1 |
| 80 | 1 | 1 | 1 | 1 | 1 | 1 | 1 | 1 | 1 | 1 | 1 | 1 | 1 | 1 | 1 | 1 | 1 |
| 96 | 1 | 1 | 1 | 1 | 1 | 1 | 1 | 1 | 1 | 1 | 1 | 1 | 1 | 1 | 1 | 1 | 1 |
| 112 | 1 | 1 | 1 | 1 | 1 | 1 | 1 | 1 | 1 | 1 | 1 | 1 | 1 | 1 | 1 | 1 | 1 |
| 128 | 1 | 1 | 1 | 1 | 1 | 1 | 1 | 1 | 1 | 1 | 1 | 1 | 1 | 1 | 1 | 1 | 1 |
| 144 | 1 | 1 | 1 | 1 | 1 | 1 | 1 | 1 | 1 | 1 | 1 | 1 | 1 | 1 | 1 | 1 | 1 |
| 160 | 1 | 1 | 1 | 1 | 1 | 1 | 1 | 1 | 1 | 1 | 1 | 1 | 1 | 1 | 1 | 1 | 1 |
| 176 | 1 | 1 | 1 | 1 | 1 | 1 | 1 | 1 | 1 | 1 | 1 | 1 | 1 | 1 | 1 | 1 | 1 |
| 192 | 1 | 1 | 1 | 1 | 1 | 1 | 1 | 1 | 1 | 1 | 1 | 1 | 1 | 1 | 1 | 1 | 1 |
| 208 | 1 | 0.9 | 1 | 1 | 1 | 1 | 1 | 1 | 1 | 1 | 1 | 1 | 1 | 1 | 1 | 0.9 | 1 |
| 224 | 1 | 0.9 | 0.9 | 1 | 1 | 1 | 1 | 1 | 1 | 1 | 1 | 1 | 1 | 1 | 0.9 | 0.9 | 1 |
| 240 | 1 | 1 | 0.9 | 1 | 1 | 1 | 1 | 1 | 1 | 1 | 1 | 1 | 1 | 1 | 0.9 | 1 | 1 |

*FIG. 5*

| | | |
|---|---|---|
| UL | U | UR |
| L | C | R |
| DL | D | DR |

| Ed | R | G | B |
|---|---|---|---|
| 0 | 0 | 0 | 0 |
| 16 | 10 | 10 | 10 |
| ... | ... | ... | ... |
| 127 | 120 | 120 | 120 |
| ... | ... | ... | ... |
| 255 | 144 | 144 | 144 |

DE-JAGGY PROCESSING SYSTEM AND METHOD FOR OLED DISPLAY WITH CURVED SPACE

BACKGROUND OF THE INVENTION

1. Field of the Invention

The present invention generally relates to a signal processing, and more particularly to a de-jaggy processing system and method adaptable to an organic light-emitting diode (OLED) display.

2. Description of Related Art

An organic light-emitting diode (OLED) is a light-emitting diode (LED) in which an emissive electroluminescent layer made of organic compound, disposed between two electrodes, can emit light in response to an electric current. OLEDs may be used to make digital displays in devices such as televisions, computer monitors, and portable systems (e.g., smartphones).

As OLEDs emit light, an OLED display can work without a backlight module. Therefore, the OLED display can display deep black levels and can be made thinner and lighter than a liquid crystal display (LCD). In low ambient light conditions (such as a dark room), the OLED display can achieve a higher contrast ratio than the LCD.

An OLED display is composed of plural pixels, each of which includes a red sub-pixel, a green sub-pixel and a blue sub-pixel that are specifically arranged. However, the OLED display suffers jaggy patterns at curved bezel or a space around the OLED display. Further, the OLED display suffers aliasing (or distortion) artifacts along straight lines (e.g., verticals or horizontals) or diagonals of the OLED display.

A need has thus arisen to propose a novel scheme to remove or reduce jaggy patterns (i.e., de-jaggy) at curved bezel of the OLED display, and/or to remove or reduce aliasing artifacts of the OLED display.

SUMMARY OF THE INVENTION

In view of the foregoing, it is an object of the embodiment of the present invention to provide a de-jaggy processing system and method adaptable to an organic light-emitting diode (OLED) display to remove or reduce jaggy patterns at curved bezel or aliasing artifacts of the OLED display.

According to one embodiment, a de-jaggy processing method includes the following steps: dividing a display area of a display into a plurality of sub-areas; providing a first table composed of gray-level weights associated with corresponding luminances of each primary color for each said sub-area; providing a second table composed of distance-gain weights each correspondingly associated with a distance between a sub-pixel and a reference point; and obtaining a corrected luminance of a sub-pixel of a pixel by multiplying an original luminance of the sub-pixel by a corresponding gray-level weight and a corresponding distance-gain weight.

According to another embodiment, a de-jaggy processing method includes the following steps: providing a table composed of edge-gain weights for each primary color; determining adjacent sub-pixels for a current sub-pixel of a display; and obtaining a corrected luminance of the current sub-pixel by subtracting or adding weighted luminances of the adjacent sub-pixels from or to an original luminance of the current sub-pixel. The weighted luminance is obtained by multiplying a luminance of the adjacent sub-pixel by a corresponding edge-gain weight.

BRIEF DESCRIPTION OF THE DRAWINGS

FIG. 4 shows exemplary first tables for sub-areas, respectively;

FIG. 5 shows an exemplary second table;

DETAILED DESCRIPTION OF THE INVENTION

Figure 1A:
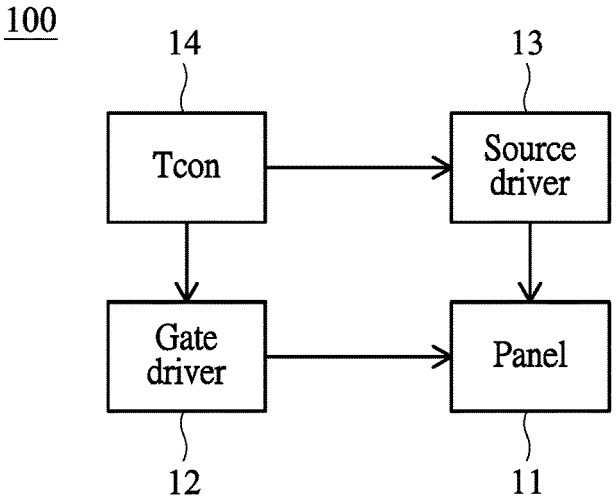
FIG. 1A shows a block diagram illustrating an organic light-emitting diode display system.

FIG. 1A shows a block diagram illustrating an organic light-emitting diode (OLED) display system 100. The OLED display system 100 may primarily include a panel 11, a gate driver 12, a source driver 13 and a timing controller (Tcon) 14. Specifically, the panel 11 may include a plurality of pixels arranged in a matrix form. The gate driver 12, controlled by the timing controller 14, may scan to turn on at least one row of pixels of the panel 11 at a time, and the source driver 13, controlled by the timing controller 14, may generate image signals for corresponding columns of the turned-on row of the panel 11.

Figure 1B:
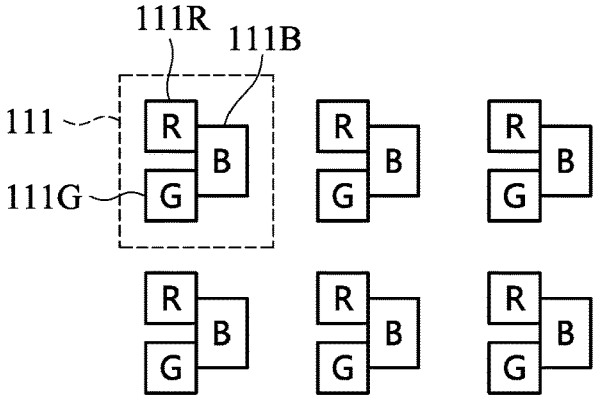
FIG. 1B shows an arrangement of first-type sub-pixels of some pixels of the panel.
Figure 1C:
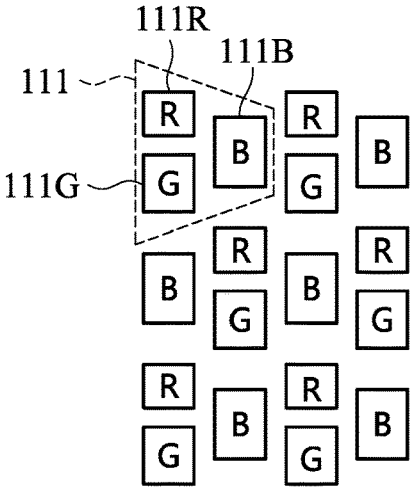
FIG. 1C shows another arrangement of second-type sub-pixels of some pixels of the panel.

FIG. 1B shows an arrangement of first-type sub-pixels of some pixels 111 of the panel 11. As shown in the figure, each pixel 111 may include three sub-pixels 111R, 111G and 111B for emitting red light, green light and blue light, respectively. FIG. 1C shows another arrangement of second-type sub-pixels of some pixels 111 of the panel 11.

Figure 2A:
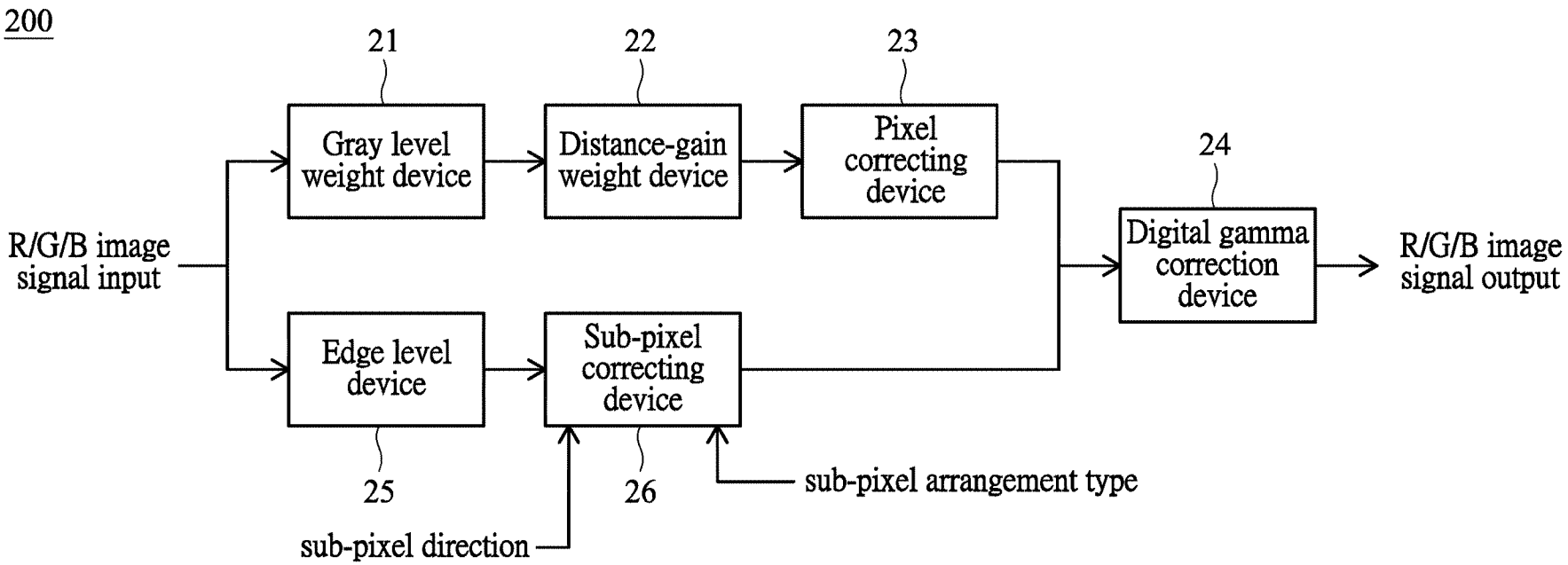
FIG. 2A shows a block diagram illustrating a de-jaggy processing system adaptable to an organic light-emitting diode (OLED) display according to one embodiment of the present invention.

FIG. 2A shows a block diagram illustrating a de-jaggy processing system 200 adaptable to an organic light-emitting diode (OLED) display to remove or reduce jaggy patterns at curved bezel or aliasing artifacts along straight lines (e.g., verticals or horizontals) or diagonals of the OLED display according to one embodiment of the present invention.

Figure 2B:
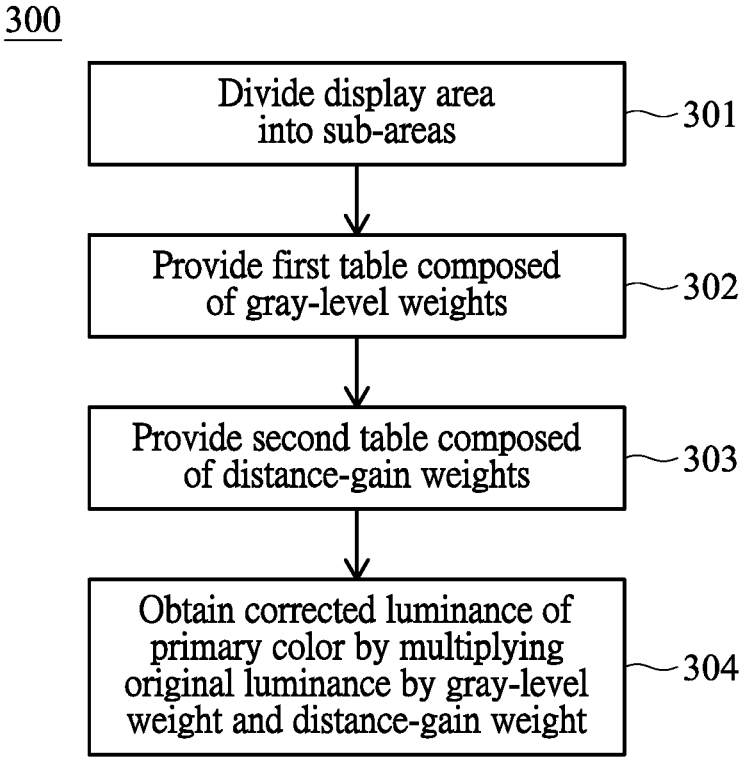
FIG. 2B shows a flow diagram illustrating a de-jaggy processing method adaptable to an organic light-emitting diode (OLED) display according to a first embodiment of the present invention.

FIG. 2B shows a flow diagram illustrating a de-jaggy processing method 300 adaptable to an organic light-emitting diode (OLED) display to remove or reduce jaggy patterns at curved bezel of the OLED display according to a first embodiment of the present invention. Although the OLED display is demonstrated, it is appreciated that the embodiment may be adapted to other displays as well.

Figure 3:
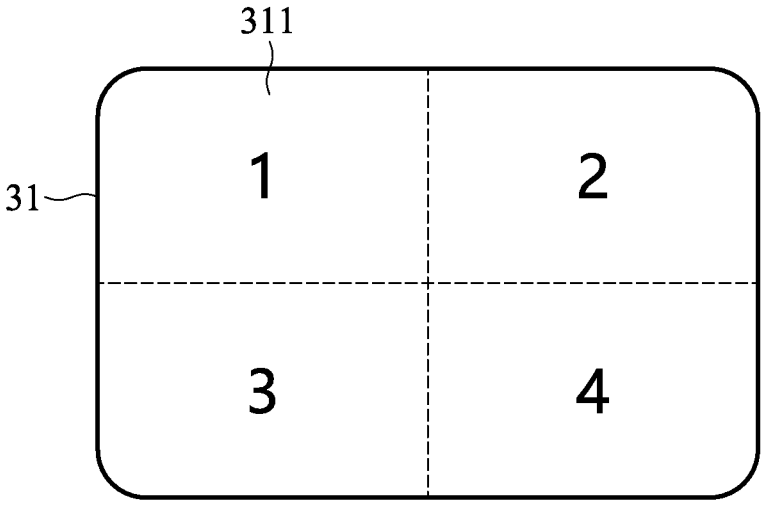
FIG. 3 shows an exemplary display area that is divided into four sub-areas.

In step 301, a display area of the OLED display is divided into a plurality of sub-areas. FIG. 3 shows an exemplary display area 31 that is divided into four sub-areas (or quadrants) 311, for example, "1," "2," "3" and "4."

In step 302, for each sub-area 311, a first table (e.g., lookup table or LUT) composed of gray-level weights for each primary color (red, green or blue) is provided by a gray-level weight device (FIG. 2A). The gray-level weights are associated with corresponding (original) luminances of the primary color. FIG. 4 shows exemplary first tables for sub-areas 311 (e.g., "1," "2," "3" and "4"), respectively. For the sub-area "1," for example, the first table includes gray-level weights (GL) associated with corresponding (original) luminances of color red (R), color green (G) and color blue (B).

Next, in step 303, a second table (e.g., lookup table or LUT) composed of distance-gain weights is provided by a distance-gain weight device 22 (FIG. 2A). Specifically, in the second table, a distance between a sub-pixel and a reference point may be associated with a corresponding distance-gain weight. FIG. 5 shows an exemplary second table composed of distance-gain weights with a reference point at the upper-left corner of the display area 31. As exemplified in the figure, distance-gain weights near four corners of the display area 31 have a value less than "1" while distance-gain weights at other locations have a value of "1."

In step 304, a corrected luminance of a primary color at each pixel may be obtained (by a pixel correcting device 23 in FIG. 2A) by multiplying (i.e., weighting) an original luminance of the primary color by a corresponding gray-level weight (of the first table) and a corresponding distance-gain weight (of the second table), and may be expressed as follows:

$$R'(x,y)=R(x,y)*\text{GL-weight}(R(x,y))*\text{DistanceGain}(R(x,y))$$

$$G'(x,y)=G(x,y)*\text{GL-weight}(G(x,y))*\text{DistanceGain}(G(x,y))$$

$$B'(x,y)=B(x,y)*\text{GL-weight}(B(x,y))*\text{DistanceGain}(B(x,y))$$

where R'/G'/B' represents the corrected luminance, R/G/B represents the original luminance, GL-weight represents the gray-level weight (of the first table), and DistanceGain represents the distance-gain weight (of the second table).

In the embodiment, the corrected luminance obtained from step 304 may be further subjected to digital gamma correction (DGC) by a digital gamma correction device 24 (FIG. 2A).

Figure 6:
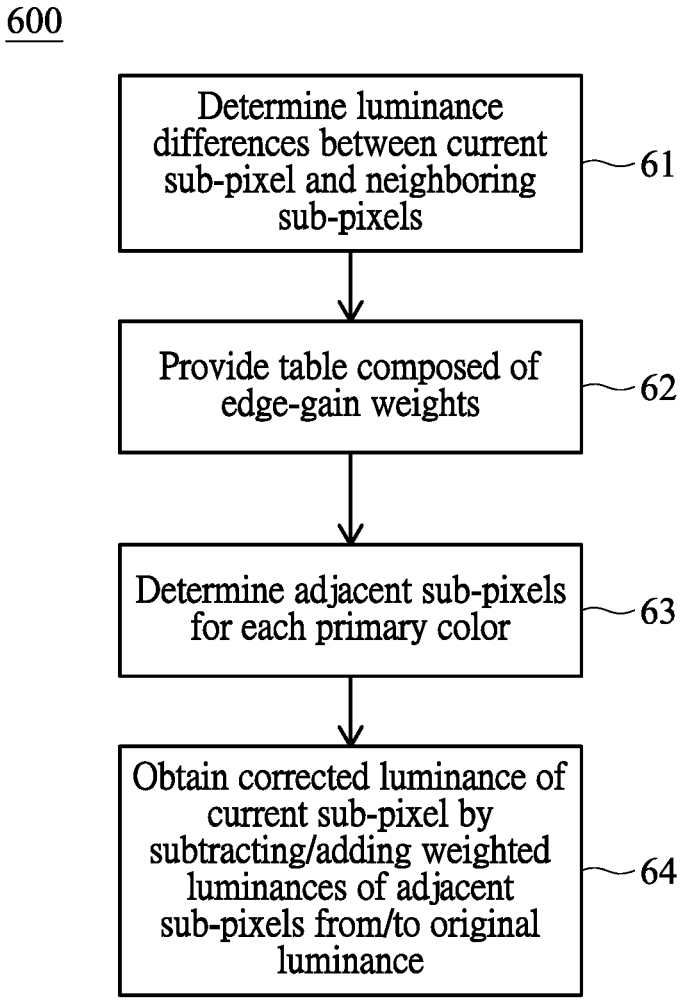
FIG. 6 shows a flow diagram illustrating a de-jaggy processing method adaptable to an organic light-emitting diode (OLED) display according to a second embodiment of the present invention.

FIG. 6 shows a flow diagram illustrating a de-jaggy processing method 600 adaptable to an organic light-emitting diode (OLED) display to remove or reduce aliasing artifacts along straight lines (e.g., verticals or horizontals) or diagonals of the OLED display according to a second embodiment of the present invention. Although the OLED display is demonstrated, it is appreciated that the embodiment may be adapted to other displays as well.

Figures 7, 8, 9:
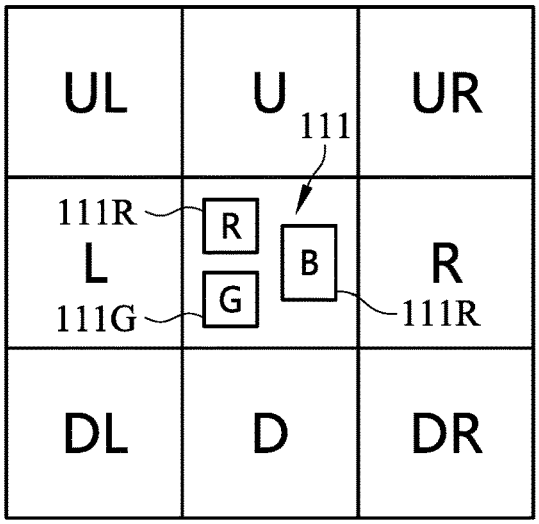
FIG. 7 exemplifies a current sub-pixel and neighboring subpixels.
FIG. 8 shows an exemplary table composed of edge-gain weights for color red, color green and color blue.
FIG. 9 exemplifies a pixel composed of three sub-pixels for color red, color green and color blue respectively.

In step 61, luminance differences (or edge levels) between a current sub-pixel and neighboring sub-pixels are determined by an edge level device 25 (FIG. 2A). FIG. 7 exemplifies a current sub-pixel C and neighboring subpixels (i.e., an upper-left sub-pixel UL, an upper sub-pixel U, an upper-right sub-pixel UR, a left sub-pixel L, a right sub-pixel R, a lower-left sub-pixel DL, a lower sub-pixel D and a lower-right sub-pixel DR). The luminance differences (or edge levels or Ed) of different directions for color red may be expressed as follows:

$$EdU_R=(R(x,y)-R(x,y-1))$$

$$EdL_R=(R(x,y)-R(x-1,y))$$

$$EdR_R=(R(x,y)-R(x+1,y))$$

$$EdUL_R=(R(x,y)-R(x-1,y-1))$$

$$EdUR_R=(R(x,y)-R(x+1,y-1))$$

$$EdD_R=(R(x,y)-R(x,y+1))$$

$$EdDL_R=(R(x,y)-R(x-1,y+1))$$

$$EdDR_R=(R(x,y)-R(x+1,y+1))$$

Similarly, the luminance differences (or edge levels or Ed) of different directions for color green may be expressed as follows:

$$EdU_G=(G(x,y)-G(x,y-1))$$

$$EdL_G=(G(x,y)-G(x-1,y))$$

$$EdR_G=(G(x,y)-G(x+1,y))$$

$$EdUL_G=(G(x,y)-G(x-1,y-1))$$

$$EdUR_G=(G(x,y)-G(x+1,y-1))$$

$$EdD_G=(G(x,y)-G(x,y+1))$$

$$EdDL_G=(G(x,y)-G(x-1,y+1))$$

$$EdDR_G=(G(x,y)-G(x+1,y+1))$$

The luminance differences (or edge levels or Ed) of different directions for color blue may be expressed as follows:

$$EdU_B=(B(x,y)-B(x,y-1))$$

$$EdL_B=(B(x,y)-B(x-1,y))$$

$$EdR_B=(B(x,y)-B(x+1,y))$$

$$EdUL_B=(B(x,y)-B(x-1,y-1))$$

$$EdUR_B=(B(x,y)-B(x+1,y-1))$$

$$EdD_B=(B(x,y)-B(x,y+1))$$

$$EdDL_B=(B(x,y)-B(x-1,y+1))$$

$$EdDR_B=(B(x,y)-B(x+1,y+1))$$

In the embodiment, the luminance differences as determined above may be used to determine whether aliasing artifacts exist along straight lines (e.g., verticals or horizontals) or diagonals of the OLED display.

Next, in step 62, a (third) table (e.g., lookup table or LUT) composed of edge-gain weights for each primary color (red, green or blue) is provided. The edge-gain weights are associated with corresponding luminance differences of the primary color. FIG. 8 shows an exemplary table composed of edge-gain weights for color red, color green and color blue.

In step 63, nearest adjacent sub-pixels for each primary color may be determined. FIG. 9 exemplifies a pixel 111 composed of three sub-pixels 111R, 111G and 111B for color red, color green and color blue respectively. If a sub-pixel correcting device 26 (FIG. 2A) determines that the arrangement of sub-pixels is first-type (e.g., FIG. 1B), the sub-pixel 111R for color red or the sub-pixel 111G for color green is nearest adjacent to neighboring sub-pixels U, UL, L, DL and D; and the sub-pixel 111B for color blue is nearest adjacent to neighboring sub-pixels U, UR, R, DR and D.

In step 64, a corrected luminance of a current sub-pixel may be obtained (by the sub-pixel correcting device 26 in FIG. 2A) by subtracting or adding weighted luminances of adjacent sub-pixels from or to an original luminance of the current sub-pixel, where the weighted luminance may be obtained by multiplying (i.e., weighting) a luminance of the adjacent sub-pixel by a corresponding edge-gain weight (of the third table), and may be expressed as follows for the arrangement shown in FIG. 9:

$$R'(C)=R(C)\pm R(U)*Ed(EdU_R)/256\pm R(UL)*Ed(EdUL_R)/256\pm R(L)*Ed(EdL_R)/256\pm R(DL)*Ed(EdDL_R)/256\pm R(D)*Ed(EdD_R)/256$$

$$G'(C)=G(C)\pm G(U)*Ed(EdU_G)/256\pm G(UL)*Ed(EdUL_G)/256\pm G(L)*Ed(EdL_G)/256\pm G(DL)*Ed(EdDL_G)/256\pm G(D)*Ed(EdD_G)/256$$

$$B'(C)=B(C)\pm B(U)*Ed(EdU_B)/256\pm B(UR)*Ed(EdUR_B)/256\pm B(R)*Ed(EdR_R)/256\pm B(DR)*Ed(EdDR_B)/256\pm B(D)*Ed(EdD_B)/256$$

where R'/G'/B' represents the corrected luminance, R/G/B represents the original luminance, Ed represents the edge-gain weight, addition is adopted when the current sub-pixel is less than the adjacent sub-pixels, otherwise subtraction is adopted.

In the embodiment, the corrected luminance obtained from step 64 may be further subjected to digital gamma correction (DGC) by the digital gamma correction device 24 (FIG. 2A).

According to steps 61-64 as described above, aliasing artifacts along straight lines (e.g., verticals or horizontals) of the OLED display, particularly a gray image, may be substantially removed or reduced.

If the sub-pixel correcting device 26 (FIG. 2A) determines that the arrangement of sub-pixels is second-type (e.g., FIG. 1C), the sub-pixel 111R/G/B is nearest adjacent to neighboring sub-pixels U, L, R and D (step 63). A corrected luminance of a current sub-pixel may be expressed as follows:

$$R'(C)=R(C)\pm R(U)*Ed(EdU_R)/256\pm R(L)*Ed(EdL_R)/256\pm R(D)*Ed(EdD_R)/256\pm R(R)*Ed(EdR_R)/256$$

$$G'(C)=G(C)\pm G(U)*Ed(EdU_G)/256\pm G(L)*Ed(EdL_G)/256\pm G(D)*Ed(EdD_G)/256\pm G(R)*Ed(EdR_G)/256$$

$$B'(C)=B(C)\pm B(U)*Ed(EdU_B)/256\pm B(L)*Ed(EdL_B)/256\pm B(D)*Ed(EdD_B)/256\pm B(R)*Ed(EdR_B)/256$$

where R'/G'/B' represents the corrected luminance, R/G/B represents the original luminance, Ed represents the edge-gain weight, addition is adopted when the current sub-pixel is less than the adjacent sub-pixels, otherwise subtraction is adopted.

Accordingly, aliasing artifacts along diagonals of the OLED display, particularly a color image, may be substantially removed or reduced.

Although specific embodiments have been illustrated and described, it will be appreciated by those skilled in the art that various modifications may be made without departing from the scope of the present invention, which is intended to be limited solely by the appended claims.

What is claimed is:

1. A de jaggy processing system, comprising:

a gray-level weight device that divides a display area of a display into a plurality of sub-areas, and provides a first table composed of gray-level weights associated with corresponding luminances of only a current frame of each primary color for each said sub-area;

a distance-gain weight device that provides a second table composed of distance-gain weights each correspondingly associated with a distance between a sub-pixel and a reference point; and a pixel correcting device that obtains a corrected luminance of a sub-pixel of a pixel by multiplying an original luminance of the sub-pixel by a corresponding gray-level weight and a corresponding distance-gain weight.

2. The system of claim 1, wherein the display comprises an organic light-emitting diode display.

3. The system of claim 1, wherein distance-gain weights near four corners of the display area have a value less than distance-gain weights at locations other than the four corner.

4. The system of claim 1, wherein the sub-pixel is located at curved bezel of the display.

5. A de jaggy processing method, comprising:

dividing a display area of a display into a plurality of sub-areas;

providing a first table composed of gray-level weights associated with corresponding luminances of only a current frame of each primary color for each said sub-area;

providing a second table composed of distance-gain weights each correspondingly associated with a distance between a sub-pixel and a reference point; and obtaining a corrected luminance of a sub-pixel of a pixel by multiplying an original luminance of the sub-pixel by a corresponding gray-level weight and a corresponding distance-gain weight.

6. The method of claim 5, wherein the display comprises an organic light-emitting diode display.

7. The method of claim 5, wherein distance-gain weights near four corners of the display area have a value less than distance-gain weights at locations other than the four corner.

8. The method of claim 5, wherein the sub-pixel is located at curved bezel of the display.

9. A de jaggy processing system, comprising:

an edge level device that provides a table composed of edge-gain weights for each primary color, and determines adjacent sub-pixels for a current sub-pixel of a display; and a sub-pixel correcting device that obtains a corrected luminance of the current sub-pixel by subtracting or adding weighted luminances of the adjacent sub-pixels from or to an original luminance of the current sub-pixel;

wherein the weighted luminance is obtained by multiplying a luminance of the adjacent sub-pixel by a corresponding edge-gain weight;

wherein the edge-gain weights are associated with corresponding luminance differences between the current sub-pixel and neighboring sub-pixels, the luminance differences being determined by the edge level device.

10. The system of claim 9, wherein the display comprises an organic light-emitting diode display.

11. The system of claim 9, wherein the current sub-pixel is located at a straight line of a gray display or a diagonal line of a color display.

12. A de jaggy processing method, comprising:

providing a table composed of edge-gain weights for each primary color;

determining adjacent sub-pixels for a current sub-pixel of a display; and obtaining a corrected luminance of the current sub-pixel by subtracting or adding weighted luminances of the adjacent sub-pixels from or to an original luminance of the current sub-pixel;

wherein the weighted luminance is obtained by multiplying a luminance of the adjacent sub-pixel by a corresponding edge-gain weight;

wherein the edge-gain weights are associated with corresponding luminance differences between the current sub-pixel and neighboring sub-pixels.

13. The method of claim 12, wherein the display comprises an organic light-emitting diode display.

14. The method of claim 12, wherein the current sub-pixel is located at a straight line of a gray display or a diagonal line of a color display.

* * * * *